US005810974A

United States Patent [19]

Laapotti

[11] Patent Number: 5,810,974

[45] Date of Patent: Sep. 22, 1998

[54] PRESS SECTION INCLUDING AN EXTENDED-NIP PRESS WITH AN INTERNALLY HEATED CENTER ROLL

[75] Inventor: Jorma Laapotti, Palokka, Finland

[73] Assignee: Valmet Corporation, Helsinki, Finland

[21] Appl. No.: 732,075

[22] Filed: Oct. 16, 1996

[30] Foreign Application Priority Data

Oct. 20, 1995 [FI] Finland ..... 955014

[51] Int. Cl.[6] ..... D21F 3/04

[52] U.S. Cl. ..... 162/358.5; 162/206; 162/359.1; 492/46

[58] Field of Search ..... 162/206, 358.3, 162/358.5, 359.1, 360.2, 360.3; 492/7, 46; 165/90

[56] References Cited

U.S. PATENT DOCUMENTS

| | | | |
|---|---|---|---|
| 4,459,726 | 7/1984 | O'Brien et al. | 492/46 |
| 4,561,939 | 12/1985 | Justus | 162/360.1 |
| 4,568,423 | 2/1986 | Laapotti | 162/358 |
| 4,704,192 | 11/1987 | Cronin | 162/360.1 |
| 4,738,752 | 4/1988 | Busker et al. | 162/206 |
| 4,781,795 | 11/1988 | Miller | 162/359 |
| 4,889,598 | 12/1989 | Niskanen | 162/199 |
| 4,915,790 | 4/1990 | Dahl | 162/305 |
| 4,919,759 | 4/1990 | Ilmarinen et al. | 162/206 |
| 4,948,466 | 8/1990 | Jaakkola | 162/207 |
| 4,976,820 | 12/1990 | Laapotti | 162/206 |
| 5,120,399 | 6/1992 | Filzen | 162/205 |
| 5,269,885 | 12/1993 | Tavi | 162/358.1 |
| 5,273,626 | 12/1993 | Niskanen et al. | 162/361 |
| 5,383,833 | 1/1995 | Brugger | 492/46 |
| 5,389,205 | 2/1995 | Pajula et al. | 162/205 |
| 5,404,936 | 4/1995 | Niskanen et al. | 165/89 |
| 5,431,787 | 7/1995 | Braun et al. | 162/358.3 |
| 5,522,959 | 6/1996 | Illmarinen | 162/205 |

FOREIGN PATENT DOCUMENTS

| | | | |
|---|---|---|---|
| 0345500 | 12/1989 | European Pat. Off. . | |
| 0527881 | 2/1993 | European Pat. Off. . | |
| 0608533 | 8/1994 | European Pat. Off. . | |
| 657579 | 6/1995 | European Pat. Off. | 162/358.3 |
| 84195 | 3/1990 | Finland . | |
| 92733 | 8/1991 | Finland . | |
| 916100 | 12/1991 | Finland . | |
| 96789 | 5/1992 | Finland . | |
| 924754 | 10/1992 | Finland . | |
| 4321405 | 8/1994 | Germany . | |
| 9521962 | 8/1995 | WIPO . | |

OTHER PUBLICATIONS

Abstract of Finnish Patent Appln. No. 925634, Dec. 11, 1992, "Heatable Roll, In Particular A Press Roll Of A Paper Machine".

Abstract of Finnish Patent Appln. No. 930439, 1993, "Method For Heating A Roll, In Particular A Press Roll Of A Paper Board Machine".

Abstract of Finnish Patent Application No. 882312, 1988, "Method in the Press Treatment of a Fibrous Web".

Abstract of Finnish Patent Application No. 903916, Aug. 8, 1990, "Heatable Roll".

Abstract of Finnish Patent Application No. 901633, 1990, Variable–Crown Roll.

"Zum Einsatz von Schuhpressen bei Schreib–und Druckpapieren", A. Meinecke and K. Steiner, Wochenblatt fur Papierfabrikation, vol. 5, 1988.

*Primary Examiner*—Karen M. Hastings

[57] ABSTRACT

A press section in a paper machine including a compact combination of rolls which form a number of press nips with one another in which water is removed from a paper web. The paper web has a closed draw supported by a press fabric or by a roll face at least between the nips. The press section includes a center roll in connection with which at least two press nips are formed. The last press nip placed in connection with the center roll is an extended nip. The center roll is a roll provided with a circulation system for a heating medium and a heatable outer mantle. An outer face of the mantle of the center roll is heated by means of the circulation of the heating medium to such a temperature level that the dewatering of the paper web in the press nips arranged in connection with the center roll, in particular in the extended nip, is intensified substantially. The invention can also be accomplished in an environment in which there are two or more separate press nips, of which press nips, at least the last press nip is an extended nip.

29 Claims, 6 Drawing Sheets

FIG. 8
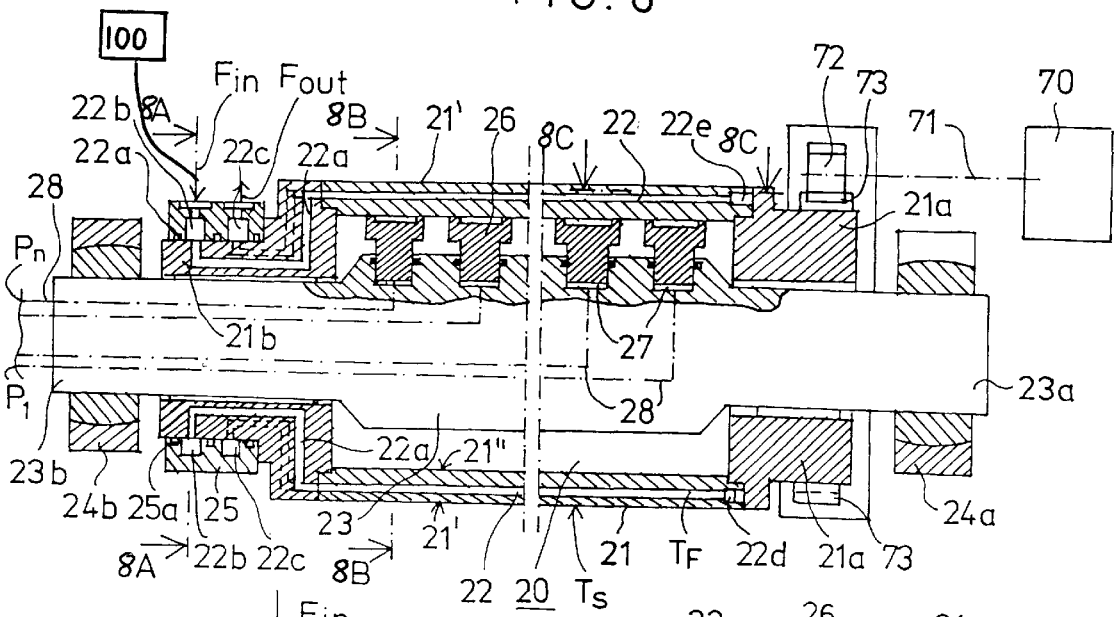
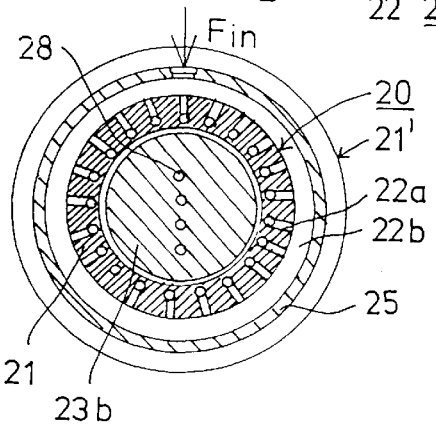
FIG. 8A
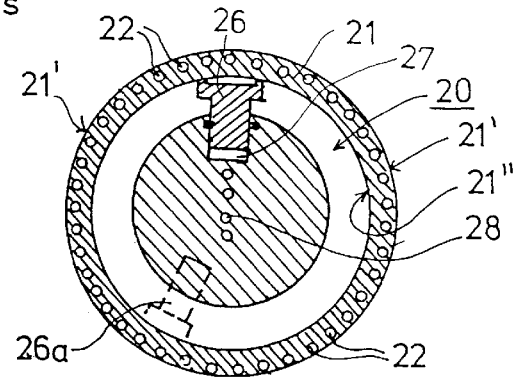
FIG. 8B
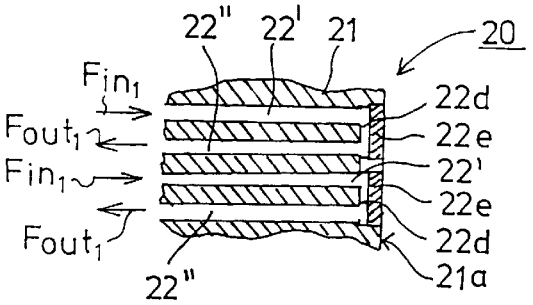
FIG. 8C

FIG. 9
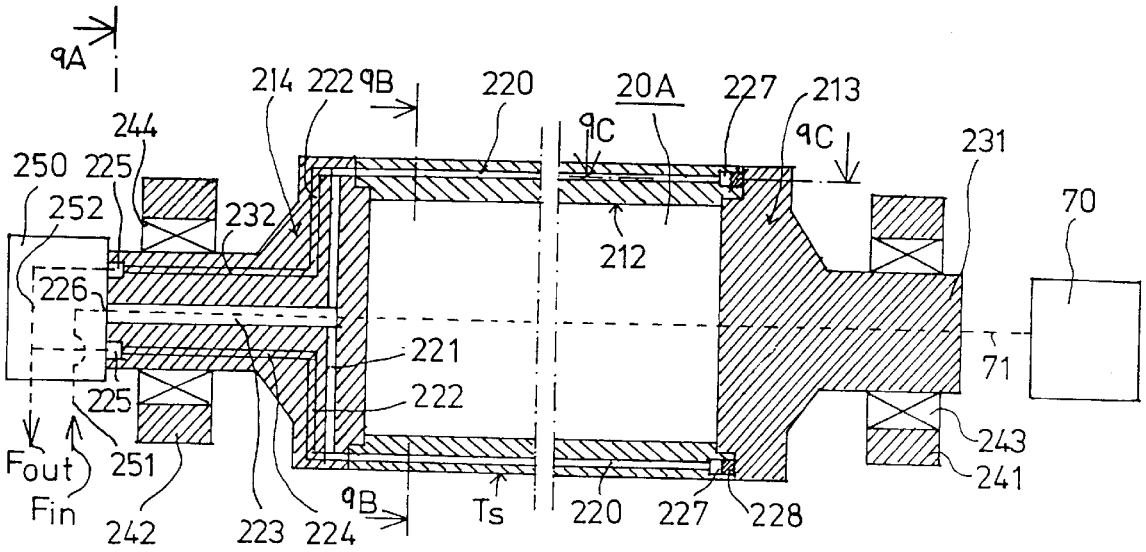
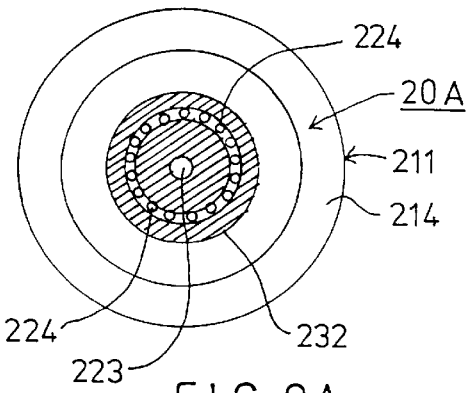
FIG. 9A
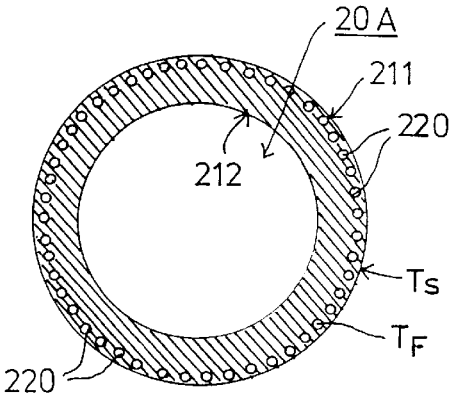
FIG. 9B
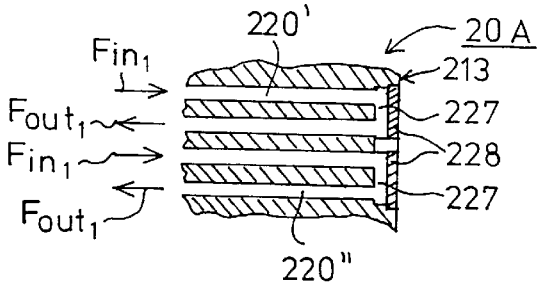
FIG. 9C

PRESS SECTION INCLUDING AN EXTENDED-NIP PRESS WITH AN INTERNALLY HEATED CENTER ROLL

FIELD OF THE INVENTION

The invention relates to a press section in a paper machine comprising a compact combination of rolls which form a number of press nips with one another. The press nips operate to remove water out of the paper web and between the press nips, the paper web preferably has a closed draw supported by a press fabric or by a roll face. The press section also includes a center roll in connection with which at least two press nips are formed.

Further, the invention relates to a press section in a paper machine comprising two or more separate press nips, at least a last one of which, in a running direction of the web and before a subsequently arranged dryer section in the paper machine, is an extended nip, and between which press nips, the paper web preferably has a closed draw supported by a roll face or a press fabric.

BACKGROUND OF THE INVENTION

In the prior art, various closed and compact press sections are known, in which there are several press nips formed between press rolls, between which nips the web has a closed draw. Of these press sections, the press section marketed by the current assignee with the product names "Sym-Press II"™ and "Sym-Press O"™ should be mentioned. In these presses, there are three successive roll nips in connection with a compact combination of rolls. If necessary, these press sections can be provided with a fourth, separate press nip.

With constantly increasing web running speeds of paper machines, the press section has unfortunately become a bottle-neck and impediment to enabling further increases in the running speeds. This impediment emanates above all from the fact that the dwell times of the web to be pressed remain insufficiently short in small roll nips and, on the other hand, the compression pressure cannot be increased infinitely without destruction of the structure of the web. To a constantly increasing extent, so-called extended-nip presses have been introduced, in which the length of the press nip zone is from 5 to 10 times the length of a standard roll nip zone. With respect to the prior art concerning press sections that make use of various extended nips and equivalent, reference is made, by way of example, to U.S. Pat. Nos. 4,561,939, 4,704,192, 4,915,790 and 5,120,399, to European Patent Applications No. 0 401 190 A3 (which corresponds to U.S. Pat. No. 5,389,205, incorporated by reference herein) and 0 608 533 A1, to German Patent Application No. 43 21 405 A1 and to European Patent 0 337 973 (which corresponds to U.S. Pat. No. 4,948,466, incorporated by reference herein).

Extended nips have also been employed in closed and compact press sections similar to those mentioned above, in which respect, reference is made to the paper Wochenblatt fur Papierfabrikation, Vol. 5, 1988; A. Meinecke und K. Steiner: "Zum Einsatz von Schuhpressen bei Schreib- und Druckpapieren", Abb 16, page 178.

Further, it is known in the prior art to use various heating devices in press sections, such as steam boxes, infrared or induction heaters, by whose means the temperature of the paper web is raised so that the dewatering is enhanced in the roll nips. This enhanced dewatering results mainly, as is well known, from the lowered viscosity of the water present in the fiber mesh of the web and from increased elasticity of the web, arising from the raised temperature.

With respect to the prior art related to the present invention and the aspect of heating the web, reference is also made to the current assignee's Finnish Patent Applications 870308 and 870309 (which correspond to U.S. Pat. Nos. 4,919,759 and 4,889,598, respectively, incorporated by reference herein). Finnish Patent Application No. 870308 describes a method and device for separating the web from a smooth-faced press roll on an unsupported draw in which the temperature of the press roll is regulated, and by means of this regulation, the adhesion between the roll face and the paper web to be separated is affected. In this manner, the angle of separation and/or the tension of separation of the paper web is/are set within an optimal range. Finnish Patent Application No. 870309 describes a method and device in which the web is separated from a smooth roll face of a center roll in the press section as an unsupported draw, and in the area of the separation point, the web is subjected to a momentary and local induction heating effect from outside the smooth-faced press roll. By means of this momentary and local heating effect, the water present between the web and the roll face and/or in the web is heated, preferably vaporized, locally in the area of the separation point so as to separate the web from the roll face (which is termed a "vaporization transfer").

In this connection, reference is also made to the current assignee's Finnish Patent 92941 (which corresponds to U.S. patent application Ser. No. 08/081,277) which describes a method in which a transfer zone is employed, over which a press fabric or a particular transfer fabric is passed so as to accomplish a closed draw of the web. The transfer zone and transfer fabric are arranged to form a transfer nip or a transfer zone with the roll face and at the transfer point, the level of the temperature of the roll face and/or of the web is set or regulated. In the method described above in Finnish Patent No. 92,941, one of the novelties is that, in the method, the transfer zone is subjected to a vacuum and at the transfer point the level of temperature of the roll face and/or the web is set or adjusted high enough so that the pressure of saturated vapor of the water present in connection with the web and the roll face, corresponding to the temperature to which the same is heated, is substantially equal to or higher than the pressure prevailing in the transfer zone, which pressure is lower than the atmospheric pressure.

Also known from the prior art for the dewatering of a paper web, there are the hot pressing devices proper, in which so-called impulse drying is used. In this mode of drying, the web is passed into connection with a face, usually a roll face, whose surface temperature is of an order of from about 150° C. to about 500° C. It is also known from the prior art to use a combination of impulse drying and an extended-nip zone, with respect to which reference is made to International Patent WO 95/21962 in the name of Beloit Technologies Inc. (publication date of Aug. 17, 1995). In the arrangement described in this publication, the paper web is pressed against a roll which has been heated to a temperature of from about 150° C. to about 500° C. in an extended-nip zone. The heating of the roll is carried out in particular by means of induction heating, and the purpose of the press device is to increase the dry solids content of the web by about 10 to about 15 percentage units and to reach dry solids contents as high as up to about 65% to about 75%.

In the prior art, rolls are known which are heated in various ways and which are meant for use in press sections and finishing devices of paper machines, such as calenders, with respect to which rolls reference is made, by way of example, to the current assignee's Finnish Laid-open Publication Nos. 87,485 (corresponding to U.S. Pat. No. 5,273, 626 incorporated by reference herein), 88,419, 89,087, 91,297 (corresponding to U.S. Pat. No. 5,404,936 incorporated by reference herein), 92,733, and to Finnish Patent Application Nos. 924754 (corresponding to U.S. patent application Ser. No. 08/017,745), 925634 and 930349.

OBJECTS AND SUMMARY OF THE INVENTION

It is an object of the present invention to provide new and improved press sections in which the web is dewatered in a novel press nip.

It is another object of the present invention to provide new and improved press sections in which the running speed of the web can be higher than in prior art press sections.

It is yet another object of the present invention to provide new and improved press sections in which it is possible to make use of the methods and the web separation and transfer arrangements described in Finnish Patent Application Nos. 870308 and 870309 and in Finnish Patent No. 92,941 synergistically.

It is another object of the present invention, with the prior art mentioned above as the starting point, to further develop press sections of paper machines, in particular of compact closed press sections, so that increased web running speeds of paper machines are permitted owing to a substantially enhanced dewatering capacity of the press section. It should be emphasized in this connection that the press section in accordance with the present invention is not designed to operate as the hot press proper and that impulse drying is not applied in the invention.

Another object of the present invention is to provide a press section in which the operation of the press can be enhanced substantially by, in particular, using inexpensive steam energy in order to increase the dewatering capacity. In the invention, the use of expensive electric energy and, thus, also of induction heating, is preferably avoided, which induction heating is applied primarily in the press section in accordance with the publication WO 95/21962.

It is yet another object of the present invention to provide a press section after which the dry solids content of the web is at the end of the press section of an order of from about 50% to about 58% depending on the paper grade, raw-material and speed of the machine.

It is a further object of the present invention to provide a press section in which the cross direction compression-pressure profile of the web, and thus the cross-direction profile of dry solids content of the web, can be regulated both in the machine direction and in the cross direction.

In view of achieving the objects stated above and others, a first embodiment of the press section in accordance with the invention comprises a center roll, a plurality of press nips formed in connection with the center roll whereby a last press nip placed in connection with the center roll is an extended nip, and the center roll is a roll provided with a circulation system for a heating medium and a heatable outer mantle. An outer face of the mantle of the center roll is heated by means of the circulation of the heating medium to such a temperature level that the dewatering of the paper web in the nips placed in connection with the center roll, in particular in the extended nip, is intensified substantially.

In a second embodiment of the press section in accordance with the invention, the press section includes at least two press nips each formed by two rolls in nip-defining relationship and one of the press rolls in the last extended nip is a press roll provided with a circulation system for a heating medium and a heatable outer mantle whereby an outer face of the mantle of the press roll is heated by means of the circulation of the heating medium to such a temperature level that the dewatering of the paper web is intensified substantially in the extended nip placed in connection with the press roll.

In the invention, by means of extended-nip pressing and by means of a heated press roll operating in its connection, in particular by means of the center roll of a closed press section, synergistic effects are obtained. This synergy is based in part on the fact that, in a press section in accordance with the invention, good thermal conductivity is obtained between the paper web that is pressed and the heated roll face, and in such a case, the wet paper web can be made to bind an abundance of energy. Thus, the temperature of the paper web that is pressed can be raised sufficiently, and this raised temperature level will be effective in the extended nip for a sufficiently long period of time and over a sufficiently long distance. In this manner, the operation of the press is intensified substantially. However, in the present invention, hot pressing and impulse drying proper are not concerned, for the heated roll face is preferably heated to a temperature lower than 100° C., ideally to a temperature in the range of from about 60° C. to about 95° C. In exceptional cases, it is also possible to use a roll face which has been heated to a temperature slightly higher than 100° C., in particular when, besides the circulation of a heating medium in the hot roll, other, outside or external devices for heating the web are used (i.e., other than by means of the center roll itself), such as a steam box, hot-water jets, and/or equivalent.

In a press section in accordance with the invention, preferably such a heated center roll is used which is provided with a mantle with axial ducts or bores through which hot water, oil or water steam is circulated, and which preferably extend substantially across the entire axial length of the mantle and/or roll. In this manner, it is possible to make use of relatively inexpensive steam energy, for example, by means of a heat exchanger, and it is unnecessary to apply induction heating and to consume expensive electric energy.

In the present invention, the surface temperature of the center roll or a corresponding smooth-faced roll in a separate nip can be regulated or set so that separation of the paper web from the center roll is facilitated, for example, when methods and arrangements that have been described in Finnish Patent Application Nos. 870308 and 870309 and in Finnish Patent No. 92,941 are utilized synergistically.

Even though, above and in the following, the press section of a paper machine and a paper web are spoken of, it is to be emphasized that the scope of the present invention also includes press sections meant for dewatering of board webs, for which press sections the invention is well suitable.

In the following, the invention will be described in detail with reference to some preferred exemplifying embodiments of the invention illustrated in the figures in the accompanying drawing. However, the invention is in no way strictly confined to the details of these embodiments alone.

BRIEF DESCRIPTION OF THE DRAWINGS

The following drawings are illustrative of embodiments of the invention and are not meant to limit the scope of the invention as encompassed by the claims.

FIG. 8 is a central axial sectional view of a variable-crown hot roll that can be applied in accordance with the invention.

FIG. 8A is a vertical sectional view taken along the line 8A—8A in FIG. 8.

FIG. 8B is a vertical sectional view taken along the line 8B—8B in FIG. 8.

FIG. 8C is a horizontal sectional view taken along the line 8C—8C in FIG. 8.

FIG. 9 is a central axial sectional view of a non-variable-crown, rigid hot roll of tubular type that can be applied in accordance with the invention.

FIG. 9A is a vertical sectional view taken along the line 9A—9A in FIG. 9.

FIG. 9B is a vertical sectional view taken along the line 9B—9B in FIG. 9.

FIG. 9C is a horizontal sectional view taken along the line 9C—9C in FIG. 9.

DETAILED DESCRIPTION OF THE PREFERRED EMBODIMENTS

Figure 1:
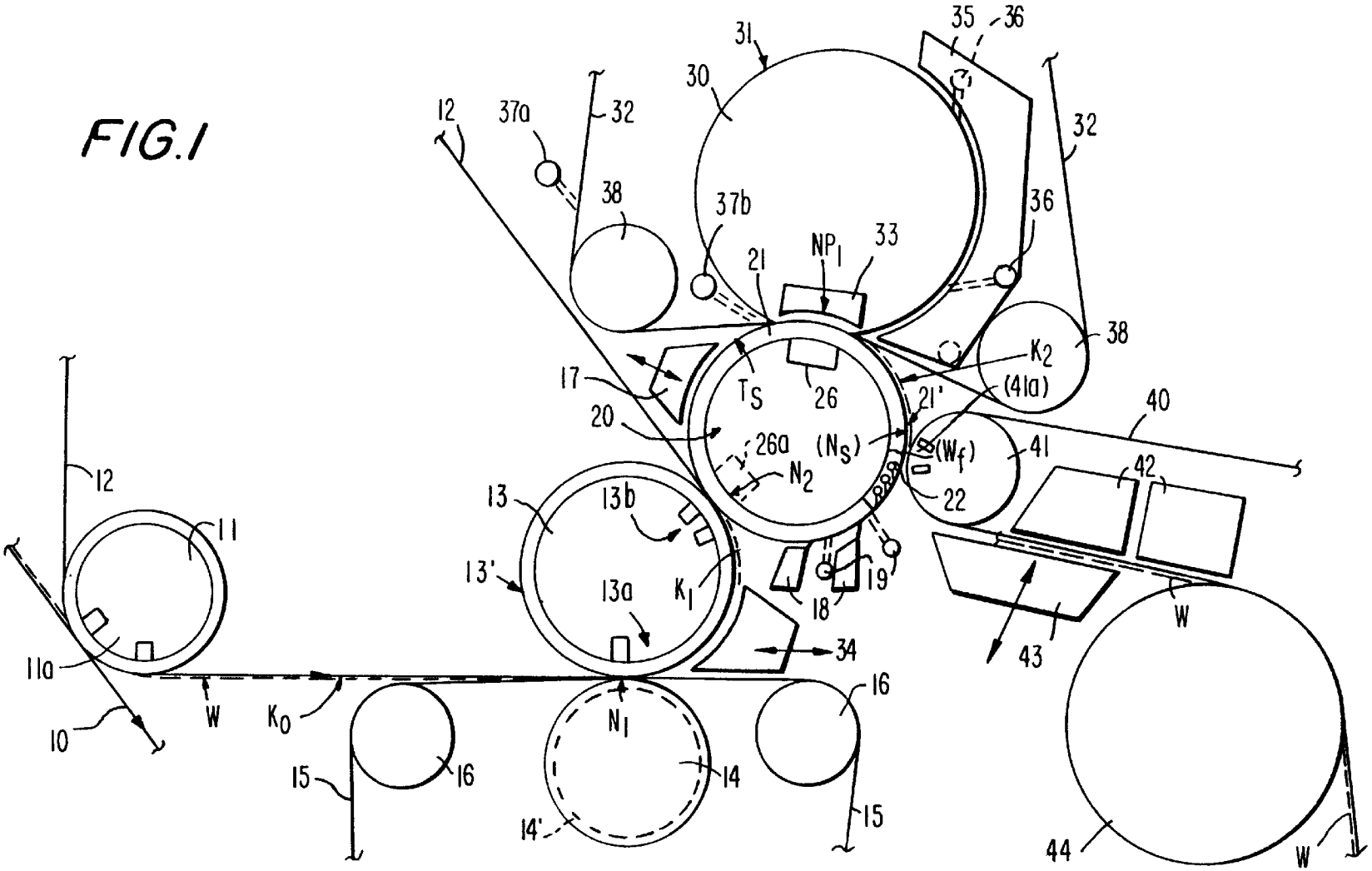
FIG. 1 is a schematic side view of the invention as applied in a three-nip press section of the current assignee's "Sym-Press II"™ type.

Referring to the accompanying drawings wherein the same reference numerals refer to the same or similar elements, the press section in accordance with the present invention that is shown in FIG. 1 has a basic geometry of a press section marketed by the current assignee with the trade mark "Sym-Press II", in which there are three successive dewatering press nips $N_1$, $N_2$ and $NP_1$. Differing from a normal "Sym-Press II" press section, the last nip $NP_1$ is expressly an extended nip having an extended-nip zone having a length of an order of from about 100 mm to about 300 mm in the machine direction. The length of the extended-nip zone $NP_1$ in the machine direction is about 3 to 10 times the corresponding length of the roll nips $N_1$ and $N_2$. The same ratio, of course, also applies to the press times in the individual nips. Also, in wider machines (the width thereof being greater than or equal to 4.5 m), in a press section in accordance with the invention, as the center roll expressly a particular variable-crown hot roll 20 is employed, of whose construction one preferred exemplifying embodiment will be described later in more detail mainly with reference to FIGS. 8, 8A, 8B and 8C. In narrower machines (the width thereof being less than 4.5 m), as a hot roll, it is also possible to use a roll with no crown variation, of which roll an example is the hot roll 20A, which is illustrated in FIGS. 9, 9A, 9B and 9C and which will be described later.

As shown in FIG. 1, the paper web W is separated by means of a suction zone 11*a* of a pick-up roll 11 from a forming wire 10 (which runs at least partially through the forming section) and passed on a lower face of a pick-up felt 12 into a first roll nip $N_1$ (the pick-up felt being guided around the pick-up roll 11). The first roll nip $N_1$ is a nip with two felts, and through this nip, a water-receiving lower felt 15 runs, besides the pick-up felt 12, and is guided by suitable guide means such as guide rolls 16 in a loop. The lower roll in the press nip $N_1$ is a press roll 14 provided with a hollow face, for example a grooved face 14', and the upper roll is a press-suction roll 13 which includes two successive suction zones 13*a* and 13*b*. In the nip $N_1$, the draining of water takes place in two directions, namely into the felts 12 and 15 through both faces of the web. The press-suction roll 13 is provided with a perforated mantle 13', and on its first suction zone 13*a*, the pick-up felt 12 and the web W placed on its outer face are curved into the second roll nip $N_2$. The second suction zone 13*b* is situated opposite the press zone of the second roll nip $N_2$ and preferably a higher vacuum is employed in suction zone 13*b* than in suction zone 13*a*. The second roll nip $N_2$ is formed between the press-suction roll 13 and a particular heated variable-crown center roll 20 which is arranged in accordance with the invention. A steam box 34 is arranged in connection with the suction zone 13*a* of the suction roll 13 in the vicinity of the outer face of the web W. By means of the steam box 34, the temperature level of the web is raised before the second roll nip $N_2$ and before the web enters into connection with the heated face 21' of the mantle 21 of the hot roll 20.

After the roll nip $N_2$, the web W follows the smooth face 21' of the center roll 20 into the third press nip, which is, according to the invention, expressly an extended nip $NP_1$ and is thus passed as a closed draw between the nips $N_2$ and $NP_1$. A water-receiving press felt 32 runs through the extended-nip zone $NP_1$ and is guided by suitable guide means therethrough such as guide rolls 38. The extended-nip zone $NP_1$ is formed by the extended-nip roll 30, together with the heated center roll 20. The extended-nip roll 30 is, for example, an extended-nip roll provided with a hose or glide-belt mantle 31 in which there is a press shoe 33 at the press zone $NP_1$. It is possible that the pressure effect of the press shoe can be profiled in the cross direction. As the extended-nip roll 30 in the extended nip $NP_1$ as shown in FIG. 1, favorably an extended-nip roll of the type marketed by the current assignee with the trade mark "Sym-Belt S"™ is used, in which the glide-belt mantle 31 is attached to tightly journalled end rings. With respect to the details of the construction and operation of a "Sym-Belt S" roll, reference is made to the current assignee's patents, viz., Finnish Patent No. 70,952 (which corresponds to U.S. Pat. No. 4,568,423 incorporated by reference herein) and European Patent Nos. 0 345 500 and 0 527 881.

A series of loading-glide shoes 26 are positioned at the extended-nip zone $NP_1$ inside the mantle 21 of the center roll 20. The cross-direction pressure profile of the nip zone $NP_1$ can be controlled by regulating the loading pressures of these shoes 26. Also at the nip $N_2$, it is possible to use a second series of glide shoes 26*a* situated inside the mantle 21 and oriented in a direction toward the nip, but corresponding in structure to the first series of glide shoes 26, whereby by means of which second series of glide shoes 26*a*, it is possible to regulate the cross-direction compression-pressure profile of the roll nip $N_2$ and control the flattening and deflection of the mantle of the center roll 20 produced by the roll nip $N_2$. Each of the series of glide shoes thus are arranged in association with loading means for producing a loading force and/or crown variation which varies in the transverse direction of the web (the cross-direction) and regulating means for regulating the cross-direction profile.

Between the nips $N_2$ and $NP_1$, the paper web W adheres to the smooth face 21' of the center roll 20 so that the web W has a free outer face, in connection with which a steam box or an infrared and/or induction heating device 17 is arranged. Preferably a steam box or an infrared heater 17 is used, whose heating effect is applied primarily to the outer face of the web W, whereas the inner face of the web W is heated by means of the heating effect of the mantle 21 of the hot roll 20 in a manner that will be described below.

After the extended-nip zone $NP_1$, the web W follows the smooth face 21' of the center roll 21, from which the web W is separated preferably as a short free draw $W_f$ and is transferred on a suction zone onto a drying wire 40 of the first cylinder group in the dryer section following after the press section. Drying wire 40 circulates around a guide roll or a vacuum roll 41. After the guide roll or vacuum roll 41, an infrared and/or steam heater 43 is arranged against the free outer face of the web W and opposite to heater 43, blow-suction boxes 42 operate in order to keep the web W on the lower face of the drying wire 40 and, at the same time, intensify the penetration of the heating effect of the device 43 into the web W. After this, the web W is passed on the drying wire 40 over a first drying cylinder 44 in the dryer section or over an equivalent lead-in cylinder of the dryer section and further as a closed draw through the first wire group in the dryer section.

In FIG. 1 moreover, at the extended nip $NP_1$, cooling-water jet devices 37*a* and 37*b* for the press felt 32 are shown, i.e., for cooling the same. After the extended nip $NP_1$, a water drain trough 35 is positioned and is arranged in connection with the mantle 31 of the hose roll 30. In connection with trough 35, washing and/or cooling jet devices 36 for washing and/or cooling the extended-nip roll mantle 31 are arranged. These jet devices 36,37*a*,37*b* operate to spray water or air or another equivalent medium. The outer face of the glide-belt mantle 31 of the extended-nip roll 30 is either smooth or hollow, for example grooved. By means of the cooling jet devices 36,37*a*,37*b*, risk of damage arising from increased temperature of the mantle 21 of the hot roll 20, e.g., resulting from quick stopping of the press section, is prevented. Moreover, the press section shown in FIG. 1 also includes doctors 18 operative against a free lower sector of the center roll 20, and in connection with the blades of the doctors 18 there are lubricating jet devices 19 which operate to spray hot water or steam against the center roll 20. In this manner, it is possible to contribute to raising the temperature level $T_S$ of the outer face 21' of the mantle 21 of the roll 20 and to intensify the cleaning of the roll nip.

In accordance with the invention, the center roll 20 is provided with internal heating, which is accomplished, for example, by means of circulating heated water or oil passed into ducts or bores 22 in the mantle 21 of the center roll, which will be described in more detail later in relation to FIGS. 8–8C and 9–9C. The web W, which was pressed in the first roll nip $N_1$ and whose dry solids content $k_1$ thereafter is of an order of from about 25% to about 40%, obtains a very good contact with the smooth outer face 21' of the mantle 21 of the center roll 20 in the short and sharp roll nip $N_2$. For this reason, in the nip $N_2$, and after it in the extended-nip zone $NP_1$, a particularly efficient transfer of heat is accomplished from the mantle 21 of the hot center roll 20 into the web W. Between the nips $N_2$ and $NP_1$, the web W is heated from the side of its outside face by means of a steam box or, in exceptional cases, by means of an infrared heater 17.

The mantle 21 of the center roll 20 can be coated and as such a coating on the mantle 21 of the center roll 20, for example, a suitable ceramic coating or a tungsten carbide metal alloy is used. Owing to efficient transfer of heat, there is a risk of cracking of the coating because of a thermal shock. In order to avoid this, it is preferable to restrict the flow of heat from the interior of the roll mantle 21 to the outer face 21' so that the temperature $T_f$ of the heating medium is selected to be as low as about 110° C. and, if necessary, additional thermal energy is passed to the face of the mantle by means of the hot-water/steam lubrication jets 19 of the doctors 18 and/or by means of a heater 17. In this manner, the temperature $T_S$ of the outer face 21' of the mantle 21 of the heated center roll 20 can be made sufficiently high. Generally, the temperature $T_S$ is selected in the range of from about 60° C. to about 95° C., preferably in a range from about 70° C. to about 85° C., with which temperature a particularly efficient dewatering is accomplished in the extended nip $NP_1$. In exceptional circumstances, the temperature level $T_S$ can be raised slightly above 100° C., in particular when auxiliary heating devices are used in connection with the roll face, such as water jets 19 and/or a steam box 17.

As is well known in the art, by means of a raised temperature level of the web, the viscosity of the water present in the fiber mesh in the web is lowered and the elastic properties of the fiber mesh are altered so as to intensify the dewatering. As this effect is produced expressly in the extended nip $NP_1$, it has an adequate time of effect in view of intensifying the dewatering. The relatively wet web placed in connection with the outer face 21' of the hot roll 20 can be made to bind an abundance of energy, and the transfer of this energy into the web W is enhanced by a good heat transfer contact and by a sufficiently large face of heat transfer between the web W and the roll face 21'.

In a press section as shown in FIG. 1, the linear loads in the roll nips $N_1$ and $N_2$ are preferably selected in a range of from about 50 kN/m to about 100 kN/m and from about 50 kN/m to about 120 kN/m, respectively. In the extended nip $NP_1$, the distribution of pressure in the machine direction and in the cross direction can be regulated in a manner in itself known to those skilled in the art. The average linear load in the extended nip $NP_1$ is preferably selected in a range of from about 300 kN/m to about 1200 kN/m.

In a press section as shown in FIG. 1, when the dry solids content $k_1$ of the web before the nip $N_2$ is typically from about 25% to about 40%, the dry solids content $k_2$ of the web after the extended nip is typically from about 50% to about 58%. The dry solids content $k_0$ of the web W before the first nip $N_1$,$NP_{10}$,$NP_{12}$ in the press section is typically from about 13% to about 23%. It will be appreciated by those skilled in the art that these dry solids content are preferable for the specific embodiment shown in FIG. 1 but modifications to the embodiment shown in FIG. 1 might result in a different preferred range of dry solids content.

The enhanced dewatering resulting from the present invention can be realized as a higher speed of the paper machine, i.e., the gain in dewatering being translated to a gain in running speed, and/or as an increased proportion of dewatering taking place by pressing, in relation to the dewatering by evaporation, which is favorable from the point of view of energy economy. The thermal capacity $P_H$ passed to the paper web W through, and in connection with, the heated center roll 20 is typically selected, per meter of width of the machine, in the range of from about 100 kW/m to about 300 kW/m, so that, in a machine of a width of 10 meters, the total thermal capacity $P_{HT}$ concerned is from about 1 MW to about 3 MW.

Figure 2:
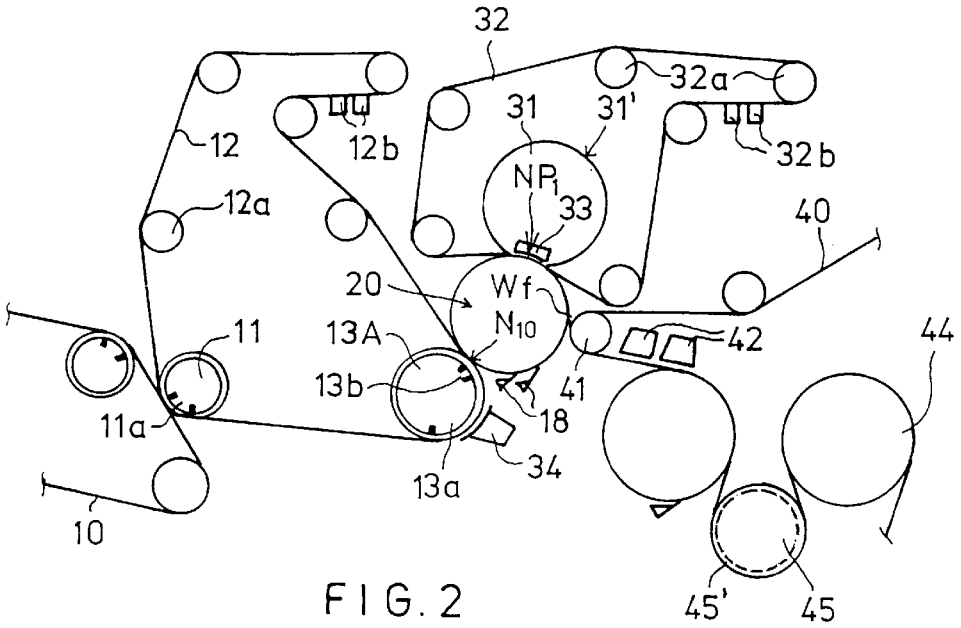
FIG. 2 is a schematic illustration of an embodiment of the invention in a press section of the "Twinver"™ type.

FIG. 2 shows a press section of the "Twinver" type as an environment of application of the invention, which press section differs from that shown in FIG. 1 in the respect that there is no first roll nip formed in connection with the pick-up felt 12 and the suction roll 13A, but rather the first nip $N_{10}$ in the press section is formed between the press suction roll 13A and the heated center roll 20 arranged in accordance with the invention. The second press zone in FIG. 2 is an extended-nip press $NP_1$ comparable to the extended nip press in the press section illustrated in FIG. 1. As an addition in relation to the press section of FIG. 1, the press section of FIG. 2 includes an illustration of guide and tensioning rolls 12*a* and conditioning devices 12*b* of the pick-up felt 12 as well as guide, alignment and tensioning rolls 32*a* and conditioning devices 32*b* of the water-receiving press felt 32 of the extended nip $NP_1$. Further, the press section of FIG. 2 shows two contact drying cylinders 44 in the first dryer group and a reversing suction roll 45 provided with a hollow-faced mantle 45' subjected to a vacuum situated between the two contact drying cylinders 44 in the first dryer group. Since in comparison to the press section shown in FIG. 1, the press section shown in FIG. 2 lacks the first two-felt roll nip $N_1$, the press section shown in FIG. 2 is more suitable for lower machine speeds and/or for thinner paper grades than the press section shown in FIG. 1.

Figure 3:
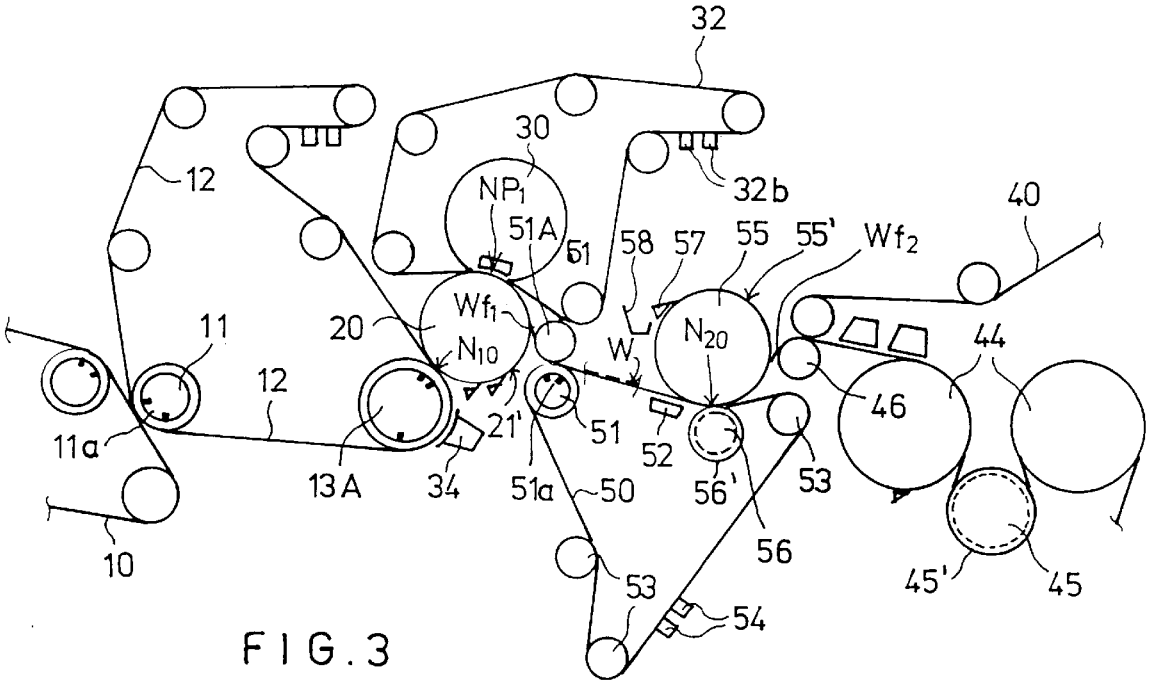
FIG. 3 shows a modification of the press section as shown in FIG. 2, wherein a third, separate press nip is additionally present.

FIG. 3 shows a modification of the press section shown in FIG. 2 in which, besides the roll nip $N_{10}$ and the extended nip $NP_1$, there is a separate roll nip $N_{20}$. The paper web W is separated from the smooth face 21' of the heated center roll 20 as a short free draw $W_{f1}$ by means of a transfer roll 51A and is passed onto the lower felt 50 with the aid of a suction zone 51*a* of the transfer suction roll 51. On a top face of the lower felt 50, the web W is passed into the third roll nip $N_{20}$. This nip $N_{20}$ is formed between a large-diameter smooth-faced 55' upper roll 55 and a hollow-faced 56' lower press roll 56. The lower felt 50 is guided by tensioning, alignment and guide rolls 53 and conditioned by conditioning devices 54. Before the roll nip $N_{20}$, there is a suction box 52, and after the roll nip $N_{20}$, the web W follows the smooth face 55' of the upper roll 55. The web is separated from the upper roll 55 by means of a transfer roll 46 as a short free draw $W_{f2}$ and transferred onto a drying wire 40 running through the first dryer group. In connection with the smooth-faced 55' upper roll 55 of the nip $N_{20}$, there is a cleaning doctor 57 operative against the upper roll 55 and a broke conveyor 58 for removing the doctored broke. In other respects, the construction and the operation of the press section shown in FIG. 3 is similar to those described in relation to FIGS. 1 and 2.

Figure 4:
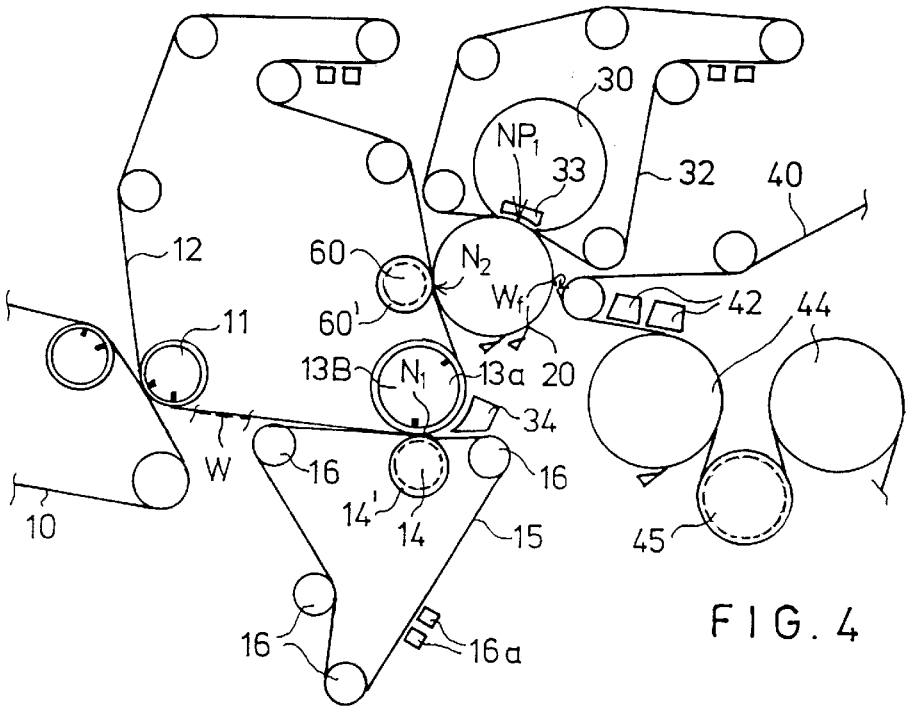
FIG. 4 shows a press section of the current assignee's "Sym-Press O"™ type as an environment of application of the invention.

FIG. 4 shows a press section of the type "Sym-Press O" as an environment of application of the invention, which press section differs from that shown in FIG. 1 in the respect that, in FIG. 4, the press suction roll 13B placed as the upper roll of the two-felt 12,15 roll nip $N_1$ does not form a press nip with the heated center roll 20, but rather the web W and the pick-up felt 12 have an almost vertical free run after the suction zone 13*a* of the press suction roll 13B onto the heated center roll 20 in connection with which there is the second roll nip $N_2$. This second roll nip $N_2$ is formed by a hollow-faced 60' press roll 60, as well as the heated center roll 20. In most other respects, the construction and the operation of the press section shown in FIG. 4 are similar to those shown in FIG. 1. Also, constructional details of the other press sections described herein, such as those included in the press sections of FIGS. 2 and 3 above, can also be applied in conjunction with the press section shown in FIG. 4.

Figure 5:
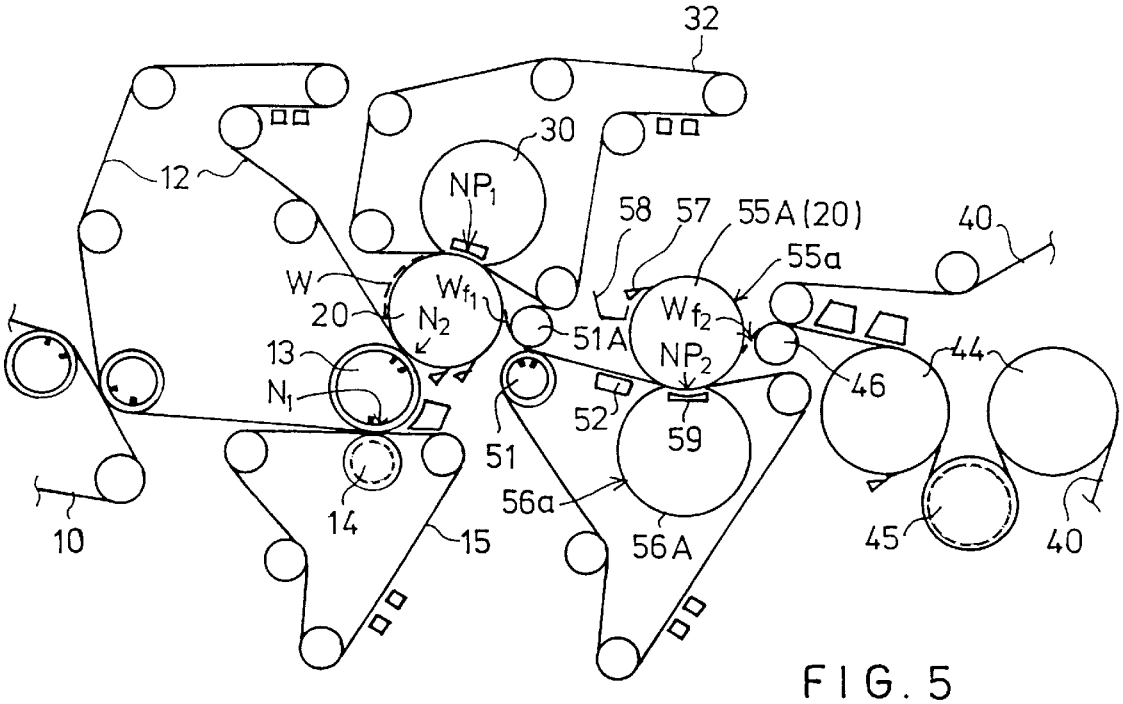
FIG. 5 shows a modification of the press section as shown in FIG. 1 in which an extended nip is used as an additional, separate fourth press zone.

FIG. 5 shows such a press section of the "Sym-Press II" type intended for particularly high-speed paper machines and/or for thicker paper grades as is provided with a separate fourth nip, which is expressly an extended nip $NP_2$. Thus, the construction and the operation of the press section shown in FIG. 5 are similar to those described above in relation to the press section shown in FIG. 3, except that the separate roll nip $N_{20}$ shown in FIG. 3 has been substituted for by an extended nip $NP_2$ whose lower roll is an extended-nip roll 56A provided with a hose mantle 56*a* and including a series of loading shoes 59. The upper roll of the extended nip $NP_2$ is a smooth-faced 55*a* press roll 55A, from which the web W is passed as a free draw $W_{f2}$ onto the transfer roll 46 and further onto the drying wire 40 in the manner described above. If it is desired in the extended nip $NP_2$ to use the enhancement of dewatering in accordance with the invention achieved by means of raised temperature, similarly to the first extended nip $NP_1$ and to the roll nip $N_2$, the upper roll 55A of the latter extended nip $NP_2$ can be substituted for by a roll provided with a heated mantle, which is represented in FIG. 5 by the reference numeral 20 in brackets. It will be recognized by those skilled in the art that constructional details of the other press sections described herein can also be applied in conjunction with the press section shown in FIG. 5.

Figure 6:
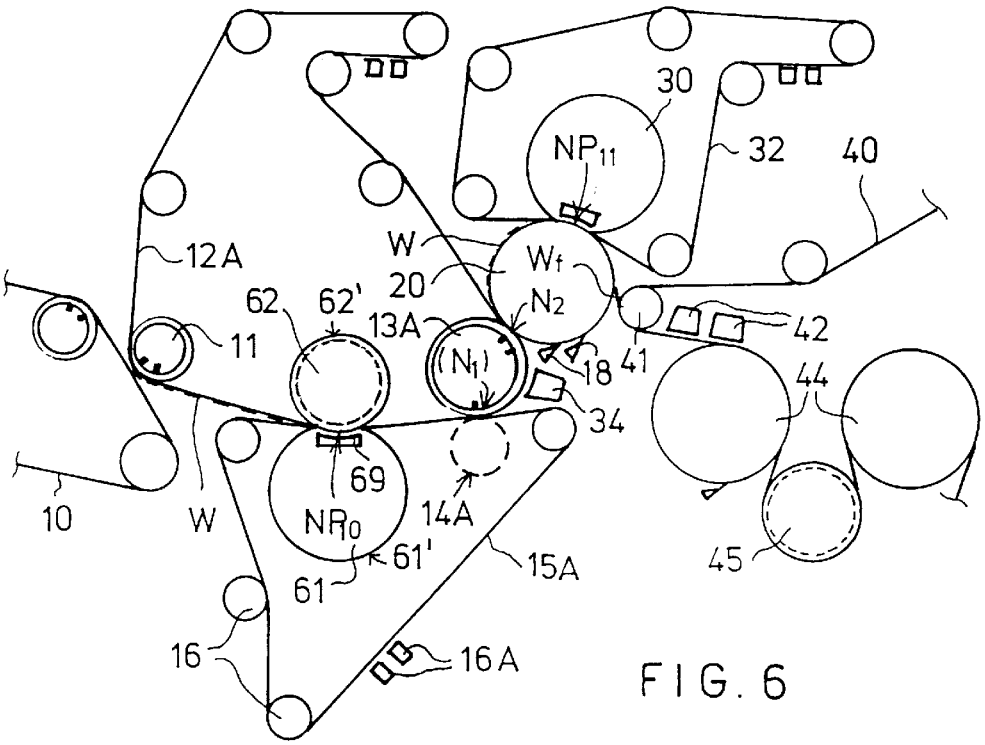
FIG. 6 shows a press section, mainly of the "Sym-Press II"™ or "Twinver"™ type, in which there is an additional extended nip as the first press nip.

FIG. 6 shows an embodiment of the invention in which there is a closed press section of the type "Sym-Press II" or "Twinver", which is preceded by an extended nip $NP_{10}$ as the first dewatering nip. The pick-up felt 12A runs as the upper fabric and the lower felt 15A runs as the lower fabric through the extended nip $NP_{10}$ and the lower felt 15A carries the web W onto the suction roll 13A. In connection with the suction roll 13A, if necessary, a roll nip can be arranged, which is represented by the reference denotation $N_1$ in brackets and by the lower press roll 14A drawn with a dashed line. The first extended nip $NP_{10}$ is formed by the extended-nip roll 61 which is placed inside the loop of the lower-felt 15A and is provided with a smooth-faced or hollow-faced hose mantle 61', and in which there is a series of press-glide shoes 69. The upper roll in the first extended nip $NP_{10}$ is a hollow-faced 62' press roll 62 which can be arranged as a variable-crown roll if necessary and/or desired. In the first extended-nip $NP_{10}$, a substantial proportion of the dewatering is carried out so that in the following nips $N_1$,$N_2$ and $NP_{11}$, a particularly high dry solids content is achieved even at high web running speeds.

In the embodiments of the invention described above and in those that will be described later, the temperature of the cylinder of the center roll 20 can be controlled, regulated or set also in view of the objective that the separation of the paper web from the center roll 20 or from the press rolls 20B of the extended nips shown in FIGS. 7 and 7A can be facilitated or optimized. In this connection, it is possible to use the methods and devices described in the current assignee's Finnish Patent Application Nos. 870308 and 870309 described above. Further, it is possible to modify, for example the embodiment shown in FIG. 1 so that, in the position of the roll 41, a transfer suction roll is employed, which is provided with a suction zone 41 a and which is arranged to form a transfer nip $N_S$ with low load against the mantle 22 of the center roll 20. In such a case, the web is provided with a fully closed draw onto the drying wire 40 without an open draw $W_f$. In respect of the arrangement of this transfer method, reference is made to the current assignee's Finnish Patent No. 92,941 referenced above.

Figure 7:
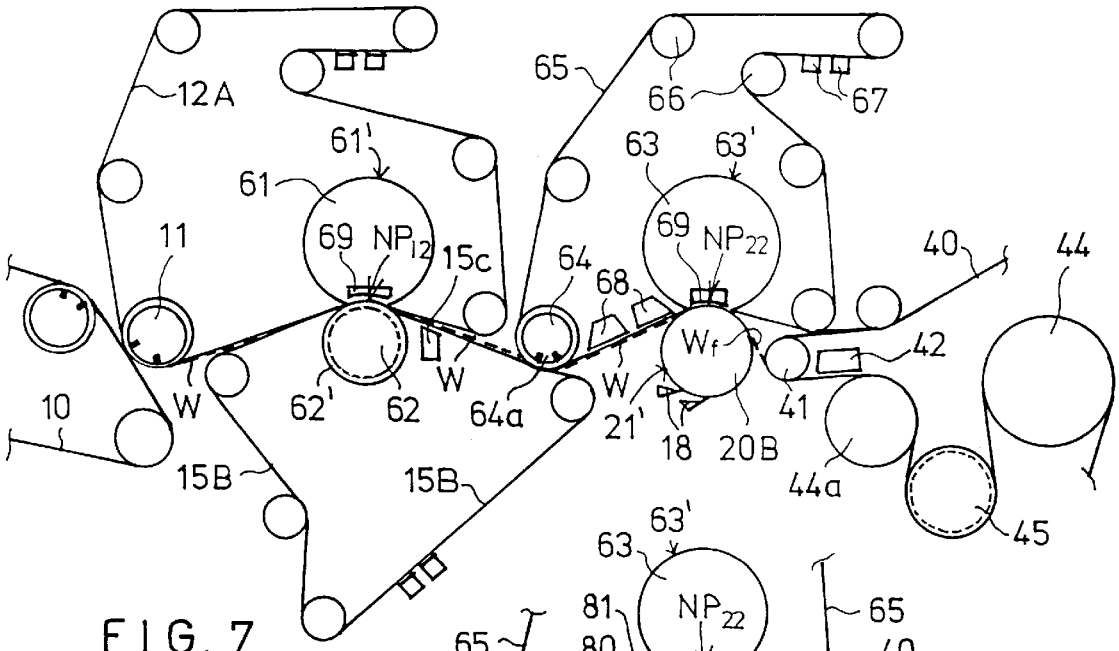
FIG. 7 shows a particular embodiment of the invention in which two successive separate extended-nip zones are employed.

FIG. 7 shows a press section in accordance with a second particular embodiment of the invention, which differs substantially from those described above and in which two separate extended-nip zones $NP_{12}$ and $NP_{22}$ are used. After the first extended nip $NP_{12}$, the web W follows the lower fabric, which is preferably a smooth-faced transfer belt 15B substantially water-non-receiving or a water-receiving press felt. The transfer of the web W onto the lower fabric 15B can be aided by means of a suction device 15*c*, such as a suction shoe or a suction roll. On the transfer belt 15B or equivalent, the web W is transferred onto an upper felt 65 of the second extended nip $NP_{22}$ by means of a suction zone 64*a* of a transfer suction roll 64, after which the web W is passed on the lower face of the upper felt 65 into the second extended-nip zone $NP_{22}$. The maintenance of the web W on the lower face of the upper felt 65 is ensured by means of vacuum boxes or blow-suction boxes 68. The upper roll of this extended-nip zone $NP_{22}$ is an extended-nip roll 63 provided with a hose mantle 63', which roll 63 includes a series of press-glide shoes 69 extending in a direction transverse to the running direction of the web, i.e., across the width of the web. The lower roll in the second extended-nip zone $NP_{22}$ is, in accordance with the second particular embodiment of the invention, a heated roll 20B having a mantle which can be arranged to be heated similarly to the mantles of the center rolls 20,20A in the press sections described above. The temperature level of the roll 20B is generally raised to a range of $T_S$ from about 65° C. to about 95° C., preferably $T_S$ is from about 70° C. to about 85° C., whereby the dewatering is promoted and intensified in the latter extended nip $NP_{22}$ formed by the heated roll 20B.

Figure 7A:
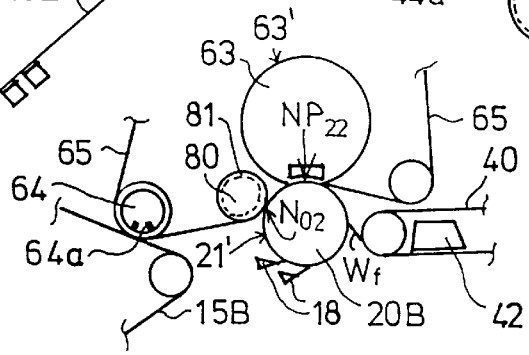
FIG. 7A shows a modification of the rear end of the press section as shown in FIG. 7 in which the last extended nip is preceded by a pre-roll nip which enhances the web heating effect.

FIG. 7A shows a modification of the embodiment of the rear end of the press section shown in FIG. 7. In this embodiment, in connection with the smooth-faced lower press roll 20B heated in accordance with the invention, before the second extended-nip zone $NP_{22}$, a pre-nip or pre-roll nip $N_{02}$ is arranged. The pre-roll nip $N_{02}$ is formed between the heated press roll 20B and a hollow-faced 81 press roll 80. The diameter of the press roll 80 is preferably just about one half of the diameter of the heated press roll 20B. By means the formation of this pre-roll nip $N_{02}$, the web W heating effect is intensified. Moreover, the pre-nip $N_{02}$ removes water into the upper felt 65. It should be emphasized that the embodiments of the invention shown in FIGS. 7 and 7A are for the most part separate and different from the embodiments shown in FIGS. 1–6, in particular in the respect that, in FIGS. 7 and 7A, an expressly heated center roll 20 is not shown in a closed and compact press roll geometry in which there is at least one extended-nip zone. However, a common feature is synergistic joint operation of an internally heated press roll 20B and an extended-nip zone $NP_{22}$ placed in its connection, and of a possible pre-nip $N_{02}$ if any, so as to intensify the dewatering by making use of the sufficiently long dwell times of the web W and the sufficiently high levels of water temperature in the fiber mesh in the web, which are accomplished in the extended nip $N_{22}$.

In the following, with reference to FIGS. 8, 8A, 8B and 8C, a preferred exemplifying embodiment of a heated center roll 20 for use in the invention will be described. The variable-crown center roll 20 comprises a static central axle 23 supported from axle journals 23*a* and 23*b* of the central axle 23 by means of bearings 24*a* and 24*b* which permit bending and are attached to the bearing supports (not shown) of the roll 20. Revolving on the static central axle 23, a cylindrical roll mantle 21 is mounted, which has a smooth cylindrical outer face 21' and a corresponding inner face 21". In the central axle 23, at the extended-nip $NP_1$, there is a series of loading glide shoes 26 by whose means regulation of the loading backup force and bending of the mantle 21 is produced in order to control the cross-direction pressure profile in the nip $NP_1$. The series of glide shoes 26 is loaded by means of separately adjustable fluid pressures $p_1 \ldots p_n$ which range between about 1.5 Mpa and about 20 Mpa passed into cylinder spaces 27 through conduit means such as pipes 28. The roll mantle 21 is attached to the ends 21*a* and 21*b*, by whose means the roll 20 is mounted so that it revolves around and on the axle 23. The roll 20 is mechanically driven from at least one end, and for this purpose there is a tooth rim 73 arranged in connection with one end 21*a* and which is driven by a shaft 71 of a drive motor 70 by means of a gear wheel 72. Other drive means could also be used in accordance with the invention. At the roll end opposite to the drive gear 70–73 of the roll 20, a static distributor coupling 25 for the circulation flow $F_{in}$-$F_{out}$ of the heating medium is arranged. The distributor coupling 25 is arranged around the revolving axle journal 21*b*, and its inside annular ducts 22*b* and 22*c* are defined by seals 25*a* to provide a sealing effect.

As shown in FIGS. 8–8C, in the mantle 21 of the hot roll 20 there is a series of axial flow ducts 22 which are connected by means of radial ducts 22*a* with annular spaces 22*b* and 22*c* in the coupling. In the end of the roll mantle 21 opposite to the coupling 25, adjacent pairs of axial flow ducts 22' and 22" are interconnected by means of end ducts 22*d* so that the flow $F_{in\ 1}$ of the heating medium passes along the ducts 22' and is reversed in the end duct 22*d* through the adjacent duct 22" as a return flow $F_{out\ 1}$ and returns into the annular space 22*c* and flows out of this annular space to the source (not shown) of heating medium. Thus, for each pair of interconnected ducts, the direction of flow of the heating medium through duct 22' is opposite to the direction of flow through duct 22". As shown in FIG. 8C, the end ducts 22*d* are defined by end walls 22*e*. In this manner, a relatively uniform distribution of the temperature $T_S$ in the outer face 21' of the roll mantle 21 is obtained. A flow distribution coupling 25 is provided at one end of the variable-crown hot roll 20 only, because the roll 20 must be provided with a mechanical drive 70–73. In FIG. 8B, a second series of loading shoes 26*a* is also shown, by means of dashed lines, which series is placed at the roll nip $N_1$ in order to control its cross-direction profile of linear load. The series 26,26*a* of loading shoes can be either hydrostatic or hydrodynamic, or they may operate by means of a combination of same.

Regulation means are arranged in association with the center roll 20 for regulating the surface temperature of the center roll 20, e.g., such that separation of the web from the center roll is facilitated. These regulation means may comprise means for controlling the temperature of the heating medium (schematically represented by the box 100 connecting to line $F_{in}$). The temperature $T_f$ of the heating medium circulating in the flow ducts 22, such as oil, water or water steam, is usually selected in the range of from about 70° C. to about 180° C., preferably from about 90° C. to about 140° C.

In FIGS. 9, 9A, 9B and 9C, an alternative embodiment is shown of a hot roll 20A applicable in the invention. The hot roll 20A is a rigid roll of tubular type, which is not provided with crown variation means. The hot roll 20A can be used, for example, in narrower machines and/or in positions in which the nip load is not particularly high. The roll 20A comprises a cylindrical roll mantle 210 having an outer face which is a smooth or hollow face 211 and an inner face 212. The roll mantle 210 is attached to end pieces 213 and 214 which include the fixed axle journals 231 and 232 of the roll 20A. The roll 20A is mounted on bearing supports 241 and 242 so that it revolves on bearings 233 and 234, and it is driven at one axial end by means of a drive gear 70 through a shaft 71 motively coupled to the drive gear 70. At the end of the roll 20A opposite to the end associated with the drive gear 70, there are coupling arrangements for the circulation flow $F_{out}$-$F_{in}$ of the heating medium. The roll mantle 210 is provided with axial flow ducts 220 having inlet ducts 220' communicating through radial ducts 221 with a central flow duct 223 placed in the axle journal 232. At the end of the axle journal 232, there is a flow distribution coupling 250, from which the inlet flow $F_{in}$ of the heating medium passes through the duct 226 first into the duct 223, and is from there divided into radial ducts 221 and further into the axial inlet ducts 220' in the roll mantle 210 (FIG. 9C) to constitute inlet flows $F_{in\ 1}$ which pass through the end ducts 227 defined by the walls 228 into the adjacent ducts 220" to constitute return flows $F_{out\ 1}$. These return flows $F_{out\ 1}$ are passed by means of radial ducts 222 into axial ducts 224 and from there further into an annular duct 225 in the end of the distribution coupling 250 and through the ducts 251 and 252 placed in connection with the annular duct 225 to make a return flow $F_{out}$ of the heating medium.

Also many other, different embodiments of the heated center roll 20,20A,20B are possible when the invention is applied. With respect to these, reference is made, by way of example, to the current assignee's Finnish Patent No. 89,085 and Finnish Patent Application No. 882312 referenced above.

The examples provided above are not meant to be exclusive. Many other variations of the present invention would be obvious to those skilled in the art, and are contemplated to be within the scope of the appended claims.

We claim:

1. A press section in a paper machine for dewatering a web, comprising a center roll over which the web runs, means defining at least a first nip with said center roll in which the web is dewatered, means defining an extended nip with said center roll in which the web is dewatered after said first nip in a running direction of the web, said second press nip being the last press nip defined in connection with said center roll prior to transfer of the web from said center roll, and said center roll comprising an outer roll mantle, first loading means for producing a loading force and/or crown variation in said extended nip operative against said roll mantle, first regulation means for regulating a cross-direction compression pressure profile of said extended nip, drive means arranged in association with said roll mantle for providing rotative force to said center roll, and circulation means for circulating a heating medium through said roll mantle to heat an outer face of said roll mantle and intensify dewatering of the web in said first press nip and said extended nip, said circulation means comprising axial ducts arranged in and extending across substantially the entire length of said roll mantle, each of said axial ducts having an inlet end and an outlet end, end ducts arranged at a first end of said roll mantle for interconnecting said axial ducts in pairs such that said outlet end of a first one of each of said interconnected pairs of axial ducts is connected to said inlet end of a second one of each of said interconnected pairs of axial ducts via one of said end ducts, and a heating-medium flow coupling arranged at a second end of said roll mantle opposite said first end of said roll mantle for passing the heating medium into said inlet end of said first one of each of said interconnected pairs of axial ducts and drawing the heating medium directly from said outlet end of said second one of each of said interconnected pairs of axial ducts, whereby the heating medium flows into said inlet end of said first one of each of said interconnected pairs of axial ducts, through said first one of each of said interconnected pairs of axial ducts from said second end of said roll mantle to said first end of said roll mantle, through said outlet end of said first one of each of said interconnected pairs of axial ducts into a respective one of said end ducts, through said end duct into said inlet end of said respective second one of each of said interconnected pairs of axial ducts, through said second one of each of said interconnected pairs of axial ducts from said first end of said roll mantle to said second end of said roll mantle and out of said second one of each of said interconnected pairs of axial ducts through said outlet ends thereof.

2. The press section of claim 1, wherein said first press roll is arranged in relation to said center roll such that said first press nip is a sharp and short roll nip, further comprising a first water-receiving press felt, first guide means for guiding said first water-receiving press felt to pick-up the web at an initial end of the press section and carry the web through said first press nip, the web being separated from said first water-receiving felt after said first press nip, a second water-receiving press felt, and second guide means for guiding said second water-receiving felt into contact with the web before said extended nip and out of contact with the web after said extended nip.

3. The press section of claim 1, wherein said center roll further comprises second loading means for producing a loading force and/or crown variation in said first press nip operative against said roll mantle, and second regulation means for regulating a cross-direction compression pressure profile of said first press nip.

4. The press section of claim 1, further comprising a second press nip arranged after said extended nip in the running direction of the web, said second press nip comprising a roll nip or an extended nip and being defined in part by a smooth-faced heated roll.

5. The press section of claim 1, wherein said center roll further comprises a central axle, said roll mantle being supported on said central axle, further comprising bearing means arranged at ends of said central axle for revolving supporting said central axle of said center roll, said heating-medium flow coupling being interposed between said roll mantle and said bearing means adjacent said second end of said roll mantle such that said circulation means do not extend through said bearing means.

6. The press section of claim 1, wherein said axial ducts in said roll mantle are interconnected only in pairs.

7. The press section of claim 1, further comprising heating means other than said circulation means arranged in connection with said center roll for raising the temperature level of said outer face of said roll mantle, said heating means being selected from the group consisting of hot-water jets for spraying hot water onto said outer face on a sector of said center roll over which the web does not run, a steam box arranged to apply steam to the web at a location between said first press nip and said extended nip, and an infrared heater arranged to heat the web at a location between said first press nip and said extended nip.

8. The press section of claim 1, wherein said circulation means are structured and arranged to raise the temperature of said outer face of said roll mantle to about 60° C. to about 95° C.

9. The press section of claim 1, wherein said circulation means are structured and arranged to provide the heating medium with a temperature in the range of from about 70° C. to about 180° C.

10. The press section of claim 1, further comprising a second press nip arranged before said first press nip in the running direction of the web.

11. The press section of claim 10, wherein said second press nip is an extended nip, further comprising a first water-receiving press felt, and first guide means for guiding said first water-receiving press felt to pick-up the web at an initial end of the press section and carry the web through said second press nip to said first press nip.

12. The press section of claim 1, further comprising regulation means arranged in association with said center roll for regulating the surface temperature of said center roll such that transfer of the web from said center roll is facilitated.

13. The press section of claim 1, further comprising a transfer suction roll arranged to define a transfer nip with said center roll at a location after said extended nip in the running direction of the web, and a wire arranged to run over said transfer suction roll, the web being transferred in said transfer nip from said center roll to said wire.

14. The press section of claim 1, further comprising support faces for supporting the web in a closed draw in its run through the press section, and a hose roll arranged to define said extended nip with said center roll, said hose roll comprising a hose mantle and a press shoe arranged in said hose mantle and oriented in a direction toward said extended nip, said press shoe being pressed toward said center roll.

15. A press section in a paper machine for dewatering a web, comprising first nip means for defining a first press nip in which the web is dewatered, said first nip means comprising first and second press rolls, extended nip means for defining an extended nip after said first nip in a running direction of the web in which the web is dewatered, said extended nip being the last press nip in the press section, the web being guided in a closed draw from said first press nip to said extended nip, and said extended nip means comprising a heated roll including an outer roll mantle, first loading means for producing a loading force and/or crown variation in said extended nip operative against said roll mantle, first regulation means for regulating a cross-direction compression pressure profile of said extended nip, drive means arranged in association with said roll mantle for providing rotative force to said heated roll, and circulation means for circulating a heating medium through said roll mantle to heat an outer face of said roll mantle and intensify dewatering of the web in said extended nip, said circulation means comprising axial ducts arranged in and extending across substantially the entire length of said roll mantle, each of said axial ducts having an inlet end and an outlet end, end ducts arranged at a first end of said roll mantle for interconnecting said axial ducts in pairs such that said outlet end of a first one of each of said interconnected pairs of axial ducts is connected to said inlet end of a second one of each of said interconnected pairs of axial ducts via one of said end ducts, and a heating-medium flow coupling arranged at a second end of said roll mantle opposite said first end of said roll mantle for passing the heating medium into said inlet end of said first one of each of said interconnected pairs of axial ducts and drawing the heating medium directly from said outlet end of said second one of each of said interconnected pairs of axial ducts, whereby the heating medium flows into said inlet end of said first one of each of said interconnected pairs of axial ducts, through said first one of each of said interconnected pairs of axial ducts from said second end of said roll mantle to said first end of said roll mantle, through said outlet end of said first one of each of said interconnected pairs of axial ducts into a respective one of said end ducts, through said end ducts into said inlet end of said respective second one of each of said interconnected pairs of axial ducts, through said second one of each of said interconnected pairs of axial ducts from said first end of said roll mantle to said second end of said roll mantle and out of said second one of each of said interconnected pairs of axial ducts through said outlet ends thereof.

16. The press section of claim 15, further comprising second nip means for defining a second press nip after said first press nip and before said extended nip in the running direction of the web, said second press nip constituting a pre-roll nip and comprising a press roll arranged in nip-defining relationship with said heated roll.

17. The press section of claim 15, wherein said first press nip is an extended nip and said extended nip means comprises third and fourth rolls, said third roll constituting said heated roll, further comprising a first fabric, first guide means for guiding said first fabric to pick-up the web at an initial end of the press section and carry the web on a lower face of said first fabric through said first press nip, a second fabric constituting a press felt or transfer belt, second guide means for guiding said second fabric through said first press nip on an upper face of said second fabric, the web being transferred from said first fabric to said second fabric in said first press nip and being carried on said second fabric after said first press nip, a third fabric, and third guide means for guiding said third fabric to receive the web from said second fabric after said first press nip and carry the web into said extended nip on a lower face of said third fabric.

18. The press section of claim 15, further comprising regulation means arranged in association with said heated roll for regulating the surface temperature of said heated roll such that transfer of the web from said heated roll is facilitated.

19. The press section of claim 15, further comprising support faces for supporting the web in a closed draw in its run through the press section, and a hose roll arranged to define said extended nip with said heated roll, said hose roll comprising a hose mantle and a press shoe arranged in said hose mantle and oriented in a direction toward said extended nip, said press shoe being pressed toward said heated roll.

20. A press section in a paper machine for dewatering a web, comprising a center roll over which the web runs, means defining at least a first nip with said center roll in which the web is dewatered, means defining an extended nip with said center roll in which the web is dewatered after said first nip in a running direction of the web, said second press nip being the last press nip defined in connection with said center roll prior to transfer of the web from said center roll, and said center roll comprising an outer roll mantle, an axle journal arranged at a first end of said roll mantle and circulation means for circulating a heating medium through said roll mantle to heat an outer face of said roll mantle and intensify dewatering of the web in said first press nip and said extended nip, said circulation means comprising axial ducts arranged in and extending across substantially the entire length of said roll mantle, end ducts arranged at a second end of said roll mantle opposite to said first end for interconnecting said axial ducts in pairs via one of said end ducts and such that the heating medium flows from said first end of said roll mantle through a first one of each of said pairs of axial ducts to said second end of said roll mantle, through a respective one of said end ducts and from said second end of said roll mantle to said first end of said roll mantle through a respective second one of each of said pairs of axial ducts, and a heating-medium flow coupling arranged at said first end of said roll mantle for passing the heating medium into said first one of each of said pairs of axial ducts and drawing the heating medium from said second one of each of said pairs of axial ducts, said heating-medium, flow coupling having a housing arranged entirely around said axle journal and defining spaces through which the heating medium flows.

21. The press section of claim 20, wherein said heat-medium flow coupling comprises first and second separated annular spaces extending around said axle journal, said first annular space being connected to said first one of each of said pairs of axial ducts and said second annular space being connected to said second one of each of said pairs of axial ducts.

22. The press section of claim 21, further comprising a first set of radial ducts arranged in said axle journal extending between said first annular space and said first one of each of said pairs of axial ducts and a second set of radial ducts extending between said second annular space and said second one of each of said pairs of axial ducts.

23. The press section of claim 20, wherein said heating-medium flow coupling is static.

24. The press section of claim 20, wherein said heating-medium flow coupling has an outer substantially circular wall surrounding said axle journal, said heat-medium flow coupling comprising first and second separated annular spaces extending between said wall and said axle journal, said first annular space being connected to said first one of each of said pairs of axial ducts and said second annular space being connected to said second one of each of said pairs of axial ducts.

25. A press section in a paper machine for dewatering a web, comprising a center roll over which the web runs, means defining at least a first nip with said center roll in which the web is dewatered, means defining an extended nip with said center roll in which the web is dewatered after said first nip in a running direction of the web, said second press nip being the last press nip defined in connection with said center roll prior to transfer of the web from said center roll, and said center roll comprising an outer roll mantle, end pieces arranged at each end of said roll mantle and circulation means for circulating a heating medium through said roll mantle to heat an outer face of said roll mantle and intensify dewatering of the web in said first press nip and said extended nip, each of said end pieces including an axle journal revolving supported on bearing means, said circulation means comprising axial ducts arranged in and extending across substantially the entire length of said roll mantle, end ducts arranged at a first end of said roll mantle for interconnecting said axial ducts in pairs via one of said end ducts and such that the heating medium flows from said first end of said roll mantle through a first one of each of said pairs of axial ducts to a second end of said roll mantle opposite to said first end of said roll mantle, through a respective one of said end ducts and from said second end of said roll mantle to said first end of said roll mantle through a respective second one of each of said pairs of axial ducts, a first one of said axle journals including a central flow duct arranged in flow communication with said first one of each of said pairs of axial ducts and axial journal ducts each arranged in flow communication with at least one of said second one of each of said pairs of axial ducts, and a heating-medium flow coupling connected to said first axle journal for passing the heating medium into said central flow duct to be passed into said first one of each of said pairs of axial ducts and drawing the heating medium from said axial journal ducts and thus from said second one of each of said pairs of axial ducts.

26. The press section of claim 25, wherein said first axle journal further comprises a first set of radial ducts for coupling said central flow duct to said first one of each of said pairs of axial ducts and a second set of radial ducts, each coupling one of said axial journal ducts to one of said second one of each of said pairs of axial ducts.

27. The press section of claim 25, wherein said heating-medium flow coupling is arranged at an end of said first axle journal.

28. The press section of claim 25, wherein said first axle journal further comprises an annular duct in flow communication with said axial journal ducts.

29. A press section in a paper machine for dewatering a web, comprising a center roll over which the web runs, means defining at least a first nip with said center roll in which the web is dewatered, and means defining an extended nip with said center roll in which the web is dewatered after said first nip in a running direction of the web, said second press nip being the last press nip defined in connection with said center roll prior to transfer of the web from said center roll;

said center roll comprising:

an outer roll mantle, circulation means for circulating a heating medium through said roll mantle to heat an outer face of said roll mantle and intensify dewatering of the web in said first press nip and said extended nip, first loading means for producing a loading force and/or crown variation in said extended nip operative against said roll mantle, first regulation means for regulating a cross-direction compression pressure profile of said extended nip, second loading means for producing a loading force and/or crown variation in said first press nip operative against said roll mantle, and second regulation means for regulating a cross-direction compression pressure profile of said first press nip, and drive means arranged in association with said first end of said roll mantle for providing rotative force to said center roll;

said circulation means comprising axial ducts arranged in and extending across substantially the entire length of said roll mantle, end ducts arranged at a first end of said roll mantle for interconnecting said axial ducts in pairs such that the heating medium follows from a second end of said roll mantle opposite to said first end through a first one of each of said pairs of axial ducts, through a respective one of said end ducts and from said first end of said roll mantle to said second end through a respective second one of each of said pairs of axial ducts, and a heating-medium flow coupling arranged at said second end of said roll mantle for passing the heating medium into said first one of each of said pairs of axial ducts and drawing the heating medium from said second one of each of said pairs of axial ducts.

* * * * *